US006695642B2

(12) United States Patent
Shindo et al.

(10) Patent No.: US 6,695,642 B2
(45) Date of Patent: Feb. 24, 2004

(54) ELECTRICAL CONNECTOR ASSEMBLY FOR FLEXIBLE FLAT CABLE

(75) Inventors: Satoru Shindo, Aichi (JP); Kazushi Miyahara, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 16 days.

(21) Appl. No.: 10/131,298

(22) Filed: Apr. 24, 2002

(65) Prior Publication Data

US 2002/0160659 A1 Oct. 31, 2002

(30) Foreign Application Priority Data

Apr. 25, 2001 (JP) ..... 2001-127947

(51) Int. Cl.[7] ..... H01R 9/07
(52) U.S. Cl. ..... 439/495
(58) Field of Search ..... 439/67, 77, 260, 439/456, 459, 465, 495, 496, 467

(56) References Cited

U.S. PATENT DOCUMENTS 5,839,916 A 11/1998 Chishima
5,904,586 A * 5/1999 Takayasu ..... 439/260
6,056,572 A * 5/2000 Matsumoto et al. ..... 439/260
6,116,947 A * 9/2000 Takayasu ..... 439/495
6,171,137 B1 1/2001 Hatakeyama
6,428,345 B2 * 8/2002 Sawayanagi et al. ..... 439/456
6,454,594 B2 * 9/2002 Sawayanagi ..... 439/456
6,471,541 B2 * 10/2002 Kunishi et al. ..... 439/495

FOREIGN PATENT DOCUMENTS

DE 79 05 611 U 11/1980

OTHER PUBLICATIONS

European Search Report, 3 pages, Aug. 27, 2002 EP 02 29 1036.

* cited by examiner

*Primary Examiner*—Javaid H. Nasri
*Assistant Examiner*—Thanh-Tam Le
(74) *Attorney, Agent, or Firm*—Rosenthal & Osha L.L.P.

(57) ABSTRACT

An electrical connector assembly for flexible flat cable used for electrically connecting a plurality of contacts and a flexible flat cable. The electrical connector assembly includes a housing in which the contacts and the flexible flat cable are inserted; and a housing lock to be freely rotatably engaged in the housing and press the flexible flat cable for the holding in such a manner as to bend the flexible flat cable. This permits the flexible flat cable to be prevented from slipping off and also permits it to be kept in its connected and held state even when used in an environment subjected to vibration and external force.

6 Claims, 9 Drawing Sheets

ELECTRICAL CONNECTOR ASSEMBLY FOR FLEXIBLE FLAT CABLE

BACKGROUND OF THE INVENTION

1. Technical Field of the Invention

The present invention relates to an electrical connector assembly for electrically connecting a flexible printed wiring board which is called FFC (Flexible Flat Cable) or FPC (Flexible Printed Cable).

2. Description of the Prior Art

An electrical connector assembly for flexible flat cable used to electrically connect a flexible printed wiring board which is called FFC or FPC is generally known which typically comprises a housing having an opening and contacts engaged in the opening and a rotary portion designed to freely open and close the opening of the housing by its rotational motion and hold the flexible flat cable in a sandwich relation when it is in its dosed position. For example, this conventional type of electrical connector assembly for flexible flat cable is disclosed by Japanese Laid-open (Unexamined) Patent Publications No. Hei 9 (1997)-17528 and No. Hei 9 (1997)-134763, for example.

These proposed ones have a temporary holding structure to locate the flexible flat cable in position and a rotary structure to make it hard for the rotary portion to slip off.

However, in the conventional type of electrical connector assembly for flexible flat cable mentioned above, the flexible flat cable is solely held by a frictional force caused by holding the flexible flat cable in sandwich relation between the rotary portion and the housing. Consequently it can be hardly said that the holding structure fully serves to prevent the flexible flat cable from slipping off. Thus, the conventional electrical connector assemblies have problems in keeping the flexible flat cable in its connected and held state, such as the problem that the flexible flat cable slips off relatively easily when used in an environment subjected to vibration and external force.

SUMMARY OF THE INVENTION

It is the object of the present invention to provide an electrical connector assembly for flexible flat cable designed to prevent the flexible flat cable from slipping off so as to surely keep it in its connected and held state even when used in an environment subjected to vibration and external force.

In accordance with one aspect of the invention, there is provided an electrical connector assembly for flexible flat cable used for electrically connecting a plurality of contacts and a flexible flat cable, the electrical connector assembly comprising (1) a housing including a contact holding portion in which the contacts are inserted and held; a guide portion in which the flexible flat cable is inserted and guided, to locate the flexible flat cable in the position in which the flexible flat cable is contactable with the contacts; and a concave portion formed to be recessed with respect to the guide portion, and (2) a housing lock to be freely rotatably engaged in the housing, the housing lock including a pressing portion to press the flexible flat cable for the holding in such a manner that the flexible flat cable as was inserted into the guide portion can be bent along the concave portion by a turning of the housing lock with respect to the housing, whereby the turning of the housing lock after the flexible flat cable is inserted and guided into the guide portion permits the contacts and the flexible flat cable to be electrically connected and also permits the flexible flat cable to be fixed in position.

With this construction, the combination of the housing having the concave portion and the housing lock to freely rotatably engage in the concave portion of the housing permits the flexible flat cable to be held in a bending manner. This can permit the contacts and the flexible flat cable to be kept in their connected and held state even when used in an environment subjected to vibration and external force.

These and other objects, features and advantages of the invention will become more apparent upon a reading of the following detailed specification with reference to the accompanying drawings.

DETAILED DESCRIPTION OF THE PREFERRED EMBODIMENTS

Figure 1:
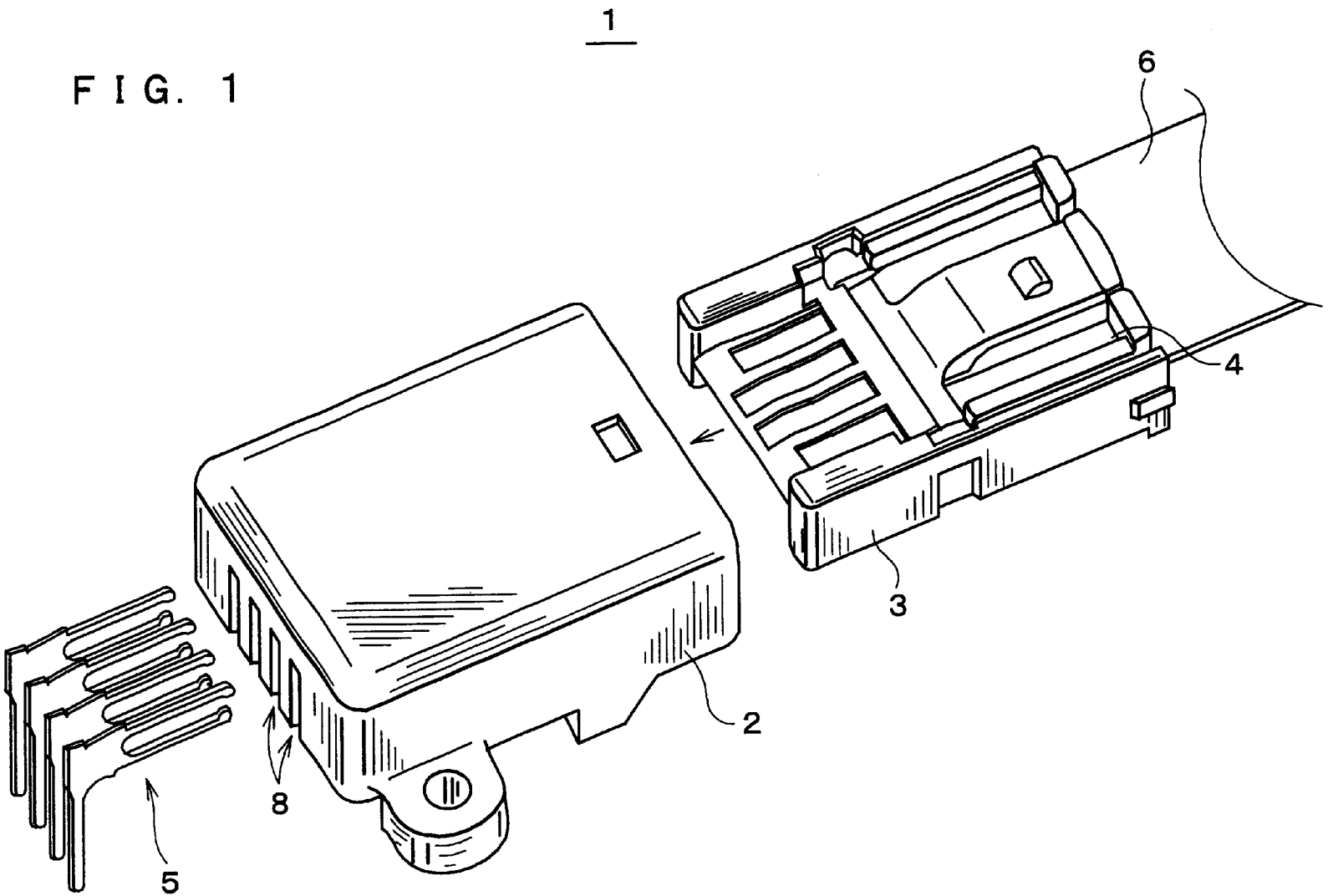
FIG. 1 is an exploded perspective view showing the entire connecting structure of an electrical connector assembly for flexible flat cable according to the present invention.

In the following, a certain preferred embodiment of the present invention will be described with reference to the accompanying drawings. Shown in FIG. 1 is an exploded perspective view showing the entire connecting structure of an electrical connector assembly 1 for flexible flat cable according to the present invention. The electrical connector assembly 1 for flexible flat cable comprises a female housing 2, a male housing 3 inserted in the female housing 2 to be fitted therein, and a housing lock 4 engaged in the male housing 3 in a freely returnable manner and inserted in the female housing 2 together with the male housing 3. These components are all formed of insulating material. A plurality of contacts 5 inserted in the female housing 2 to be held therein and a flexible flat cable 6 inserted in the male housing 3 and pressed by the housing lock 4 to be held in place are electrically connected by the insertion of the male housing 3 into the female housing 2 to be fitted therein.

While in the illustrated embodiment, the housing comprises the male housing 3 and the female housing 2 which are separate from each other, it may comprise an integral-type housing, without limiting to the illustrated one. However, the housing shown in the illustrated embodiment is preferable when the flexible flat cable is desired to be kept in its connected state further tightly in an environment greatly subjected to vibration and external force. It is particularly effective when used as an electrical connector assembly for vehicle, rather than as an internally mounted electrical connector assembly.

Figure 2:
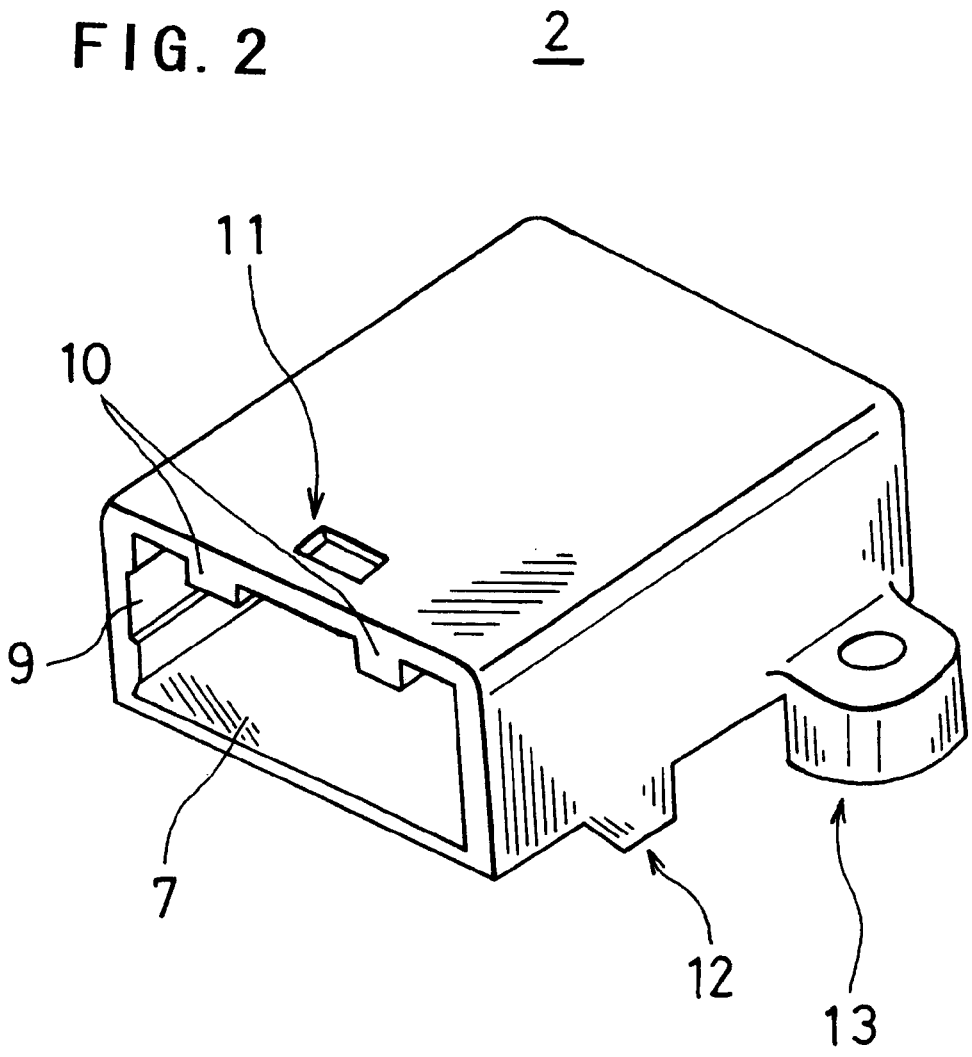
FIG. 2 is a perspective view showing a female housing of the electrical connector assembly for flexible flat cable according to the present invention.

First, the structure of each component will be described. FIG. 2 is a perspective view of the female housing 2. The female housing 2 is formed in a rectangular cylinder shape, as shown in FIG. 2. The female housing 2 has, at an end surface thereof, an opening 7 in which the male housing 3 is inserted, as mentioned later, and has, at an end surface thereof on the opposite side to the opening 7, a contact holding portion comprising slits 8 in which a plurality of contacts 5 are inserted and held, as shown in FIG. 1. As shown in FIG. 2, the female housing 2 has, in its inner wall, guide slots 9 and guide rims 10 via which the male housing 3 is guided when inserted. Also, the female housing 2 has, in its upper surface, a hole-like engaging groove 11 in which an engaging lug 26 provided in the housing lock 4 is engaged. The engaging lug 26 forms a first engaging portion and the engaging groove 11 forms a second engaging portion.

The female housing 2 thus formed is fixed in place by use of a fitting portion 12 formed in the bottom and a bolt hole 13 formed in the side surface at a lower portion thereof. Then, the plurality of contacts 5 are inserted and held in the slits 8 for alignment.

It is to be noted that the guide slots 9 and the guide rims 10 are not indispensable. Also, the fitting portion 12 and the bolt hole 13 need not necessarily be formed in the same way as in the illustrated ones, and any alternations thereof will do, as long as they can fix the female housing in place.

Figure 3:
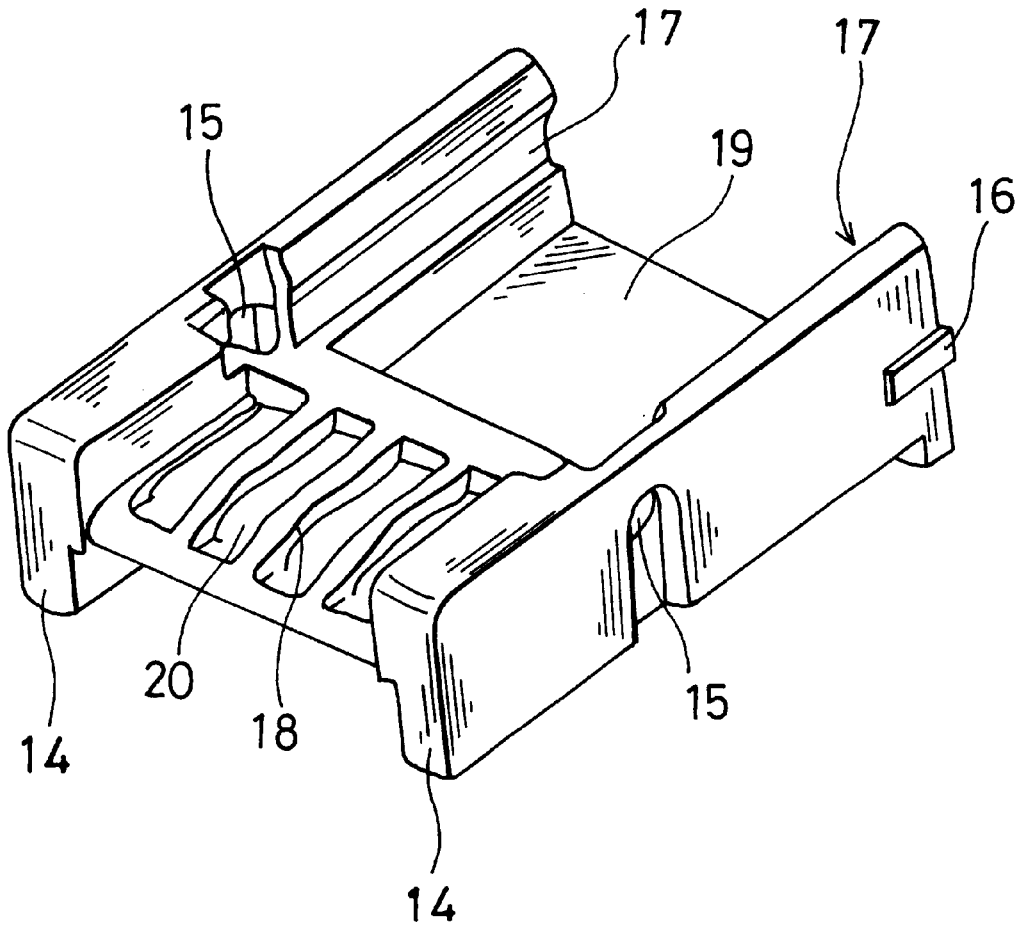
FIG. 3 is a perspective view showing a male housing of the electrical connector assembly for flexible flat cable according to the present invention.

Referring now to FIG. 3 showing a perspective view of the male housing 3, reference is given to the male housing 3 which is to be inserted in the opening 7 of the female housing 2 so as to be freely engageable in the female housing 2. The male housing 3 includes a pair of insertion guide portions 14 to be inserted and guided along the inner wall of the female housing 2 and a bridge portion bridging between the insertion guide portions 14. The insertion guide portions 14 are provided with two engaging holes 15 in which the housing lock 4 is engaged so that they can be held at two locations in such a manner as to freely rotate, as mentioned later. The insertion guide portions 14 have lugs 16 formed on outer surfaces thereof to be fitted in the guide slots 9, when inserted into the female housing 2. Also, the insertion guide portions 14 have temporary holding slots 17 formed on inner surfaces thereof to hold the housing lock 4.

The bridge portion of the male housing 3 bridging between the insertion guide portions 14 includes a guide portion 18 for guiding the insertion of the flexible flat cable 6 and a concave portion 19 formed to be recessed stepwise with respect to the guide portion 18.

Figure 10:
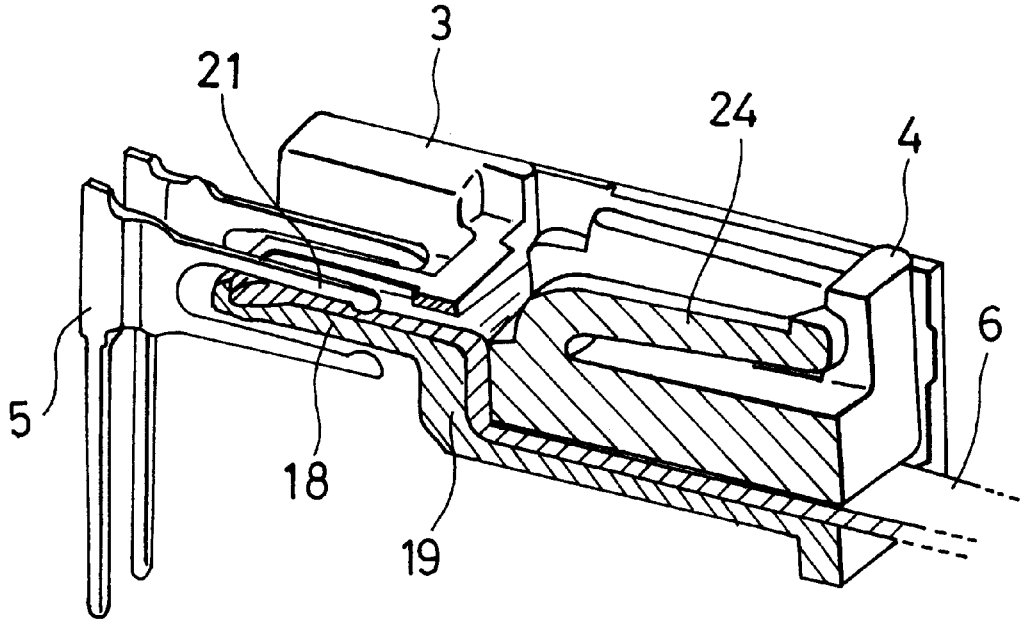
FIG. 10 is a partly sectioned perspective view of the electrical connector assembly for flexible flat cable according to the present invention.

The guide portion 18 has palisade-shaped slits 20 to allow the flexible flat cable 6 to be exposed on an upper side thereof only. Further, the guide portion 18 has the structure to abut with the flexible flat cable 6 at a front end thereof on the insertion side of the flexible flat cable 6 so as to set the flexible flat cable in position. The guide portion 18 has, at a front end portion thereof on the insertion side, a tapered portion formed partway along its length to guide the flexible flat cable 6. Shown in FIG. 10 is a partially sectioned perspective view illustrating the state in which the flexible flat cable 6 is held by the male housing 3 and the housing lock 4 and is connected with the contacts 5. In FIG. 10, the female housing 2 is omitted, for easy understanding. As shown in FIG. 10, the contacts 5 are brought into contact with the flexible flat cable 6 in the slits 20 by insertion of the male housing 3 into the female housing 2. Then, the flexible flat cable 6 is guided to the front end of the guide portion 18 so that it can have the tapered portion partway along its length. This can allow the front ends of the contacts 5 and the front end of the flexible flat cable 6 to be prevented from being interfered with each other, and as such can prevent occurrence of peeling of the flexible flat cable 6 at the front end thereof.

The concave portion 19 is formed in a step-like configuration so that the housing lock 4 can be accommodated therein when turned at a given rotation angel, as shown in FIG. 10.

Figure 5:
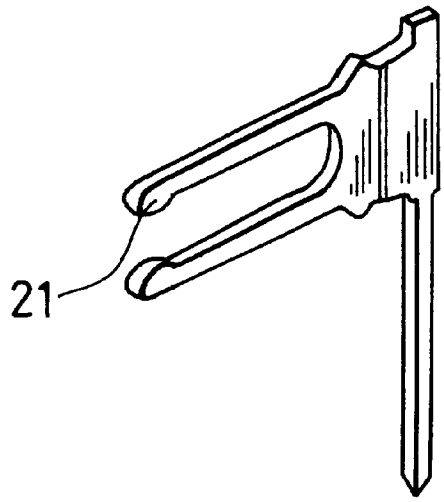
FIG. 5 is a perspective view showing a contact to be inserted in the female housing of the electrical connector assembly for flexible flat cable according to the present invention.
Figure 6:
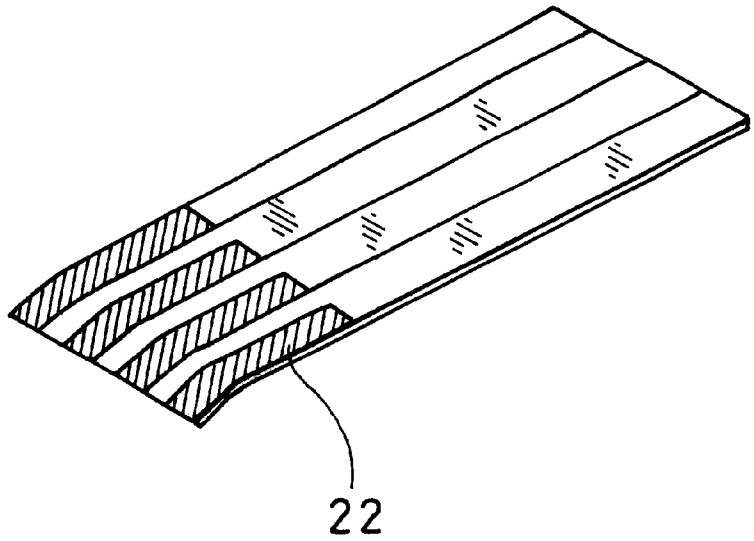
FIG. 6 is a perspective view showing a flexible flat cable to be inserted in the male housing of the electrical connector assembly for flexible flat cable according to the present invention.

The contact 5 and the flexible flat cable 6 as viewed from oblique side are shown in FIGS. 5 and 6, respectively. The contact 5 comprising electric conductor is a terminal to be electrically connected with the flexible flat cable 6. The contact 5 has a two-forked front end portion 21 which is arranged in the slit 8 formed in the female housing 2, as mentioned above. Along with the insertion of the male housing 3, the flexible flat cable 6 is so inserted as to be held in sandwich relation between the two-forked front ends 21. As a result, one of the two-forked front ends 21 of the contact 5 and one side of the flexible flat cable 6 are brought into contact with each other, as shown in FIG. 10.

The flexible flat cable 6 has an exposed front end portion 22 which is not given insulating coating so as to allow the wiring to be exposed thereat, as shown in FIG. 6. The flexible flat cable 6 is contacted with the contacts 5 at the exposed front end portion 22 so as to be electrically connected therewith.

Figure 4:
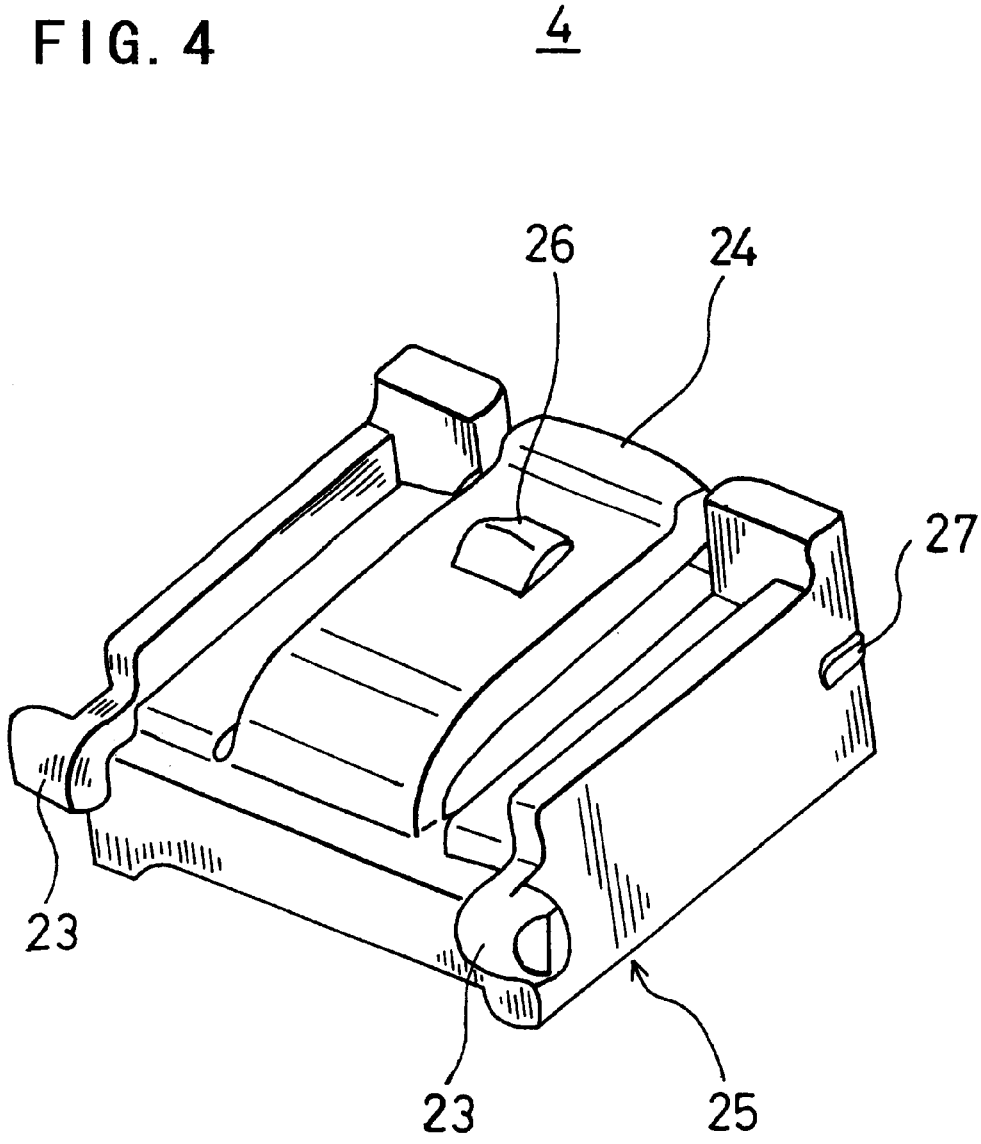
FIG. 4 is a perspective view showing a housing lock of the electrical connector assembly for flexible flat cable according to the present invention.

Finally, reference is given to the housing lock 4 with reference to FIG. 4 showing a perspective view of the housing lock 4. In FIG. 4, the housing lock 4 has a contour to be accommodated in and generally snugly fitted in the concave portion 19 of the male housing 3. The housing lock 4 has, at two locations thereof on the near side of FIG. 4, engaging shanks 23 to be freely rotatably engaged in the engaging holes 15. The housing lock 4 has, on an upper side thereof, a cantilevered holding portion 24 engageable with the female housing 2. Also, the housing lock 4 has a lower portion which forms a pressing portion 25 serving to press the flexible flat cable 6 when turned and accommodated in the male housing 3.

The two engaging shanks 23, each projecting outwardly, are each formed to have a tapered surface at projected front end portions thereof. As shown in FIG. 3, the male housing 3 has vertical slots formed at the inner side of the insertion guide portions 14 continuing into the engaging holes 15. The tapered engaging shanks 23 are pressed in along the vertical slots. Then, the engaging shanks 23 are deflected inwardly, first, and then are engaged in the engaging holes 15. At that time, the engaging shanks 23 are pressed in a direction of their confronting the concave portion 19, with their pressing portions 25 pointing downward.

As shown in FIG. 4, the cantilevered holding portion 24 is supported at one end on the upper side or non-pressing side of the housing lock 4 at a front portion thereof in a cantilevered fashion. This holding portion 24 is presented in the form of a cantilevered plate-like beam which is bent at the one end at generally 90 degree and then extends rearward along the upper side. The cantilevered holding portion 24 has, at a portion thereof on the free end side, the engaging lug 26 (first engaging portion) projecting upwardly. This engaging lug 26 is brought into engagement in the engaging groove 11 (second engaging portion) formed in the female housing 2 by a resilient bias produced when the male housing 3 and the female housing 2 are fitted to each other.

The housing lock 4 has, on its sides, temporary holding lugs 27 having an outward convex shape. The temporary holding lugs 27 are brought into engagement in the temporary holding slots 17 formed in the male housing 3 when the housing lock 4 is turned and accommodated in the male housing 3.

The electrical connector assembly 1 for flexible flat cable according to the illustrated embodiment is structured as mentioned above. Now, reference is given to the mode of operation of the contacts 5 and the flexible flat cable 6 being interconnected via the electrical connector assembly 1 for flexible flat cable.

First, the housing lock 4 is supported to the male housing 3 so as to be freely turned with respect to it by means of the engagement of the engaging shanks 23 in the engaging holes 15. When the housing lock 4 takes a position perpendicular to the male housing 3, the flexible flat cable 6 is inserted into the guide portion 18 of the male housing 3.

Figure 7:
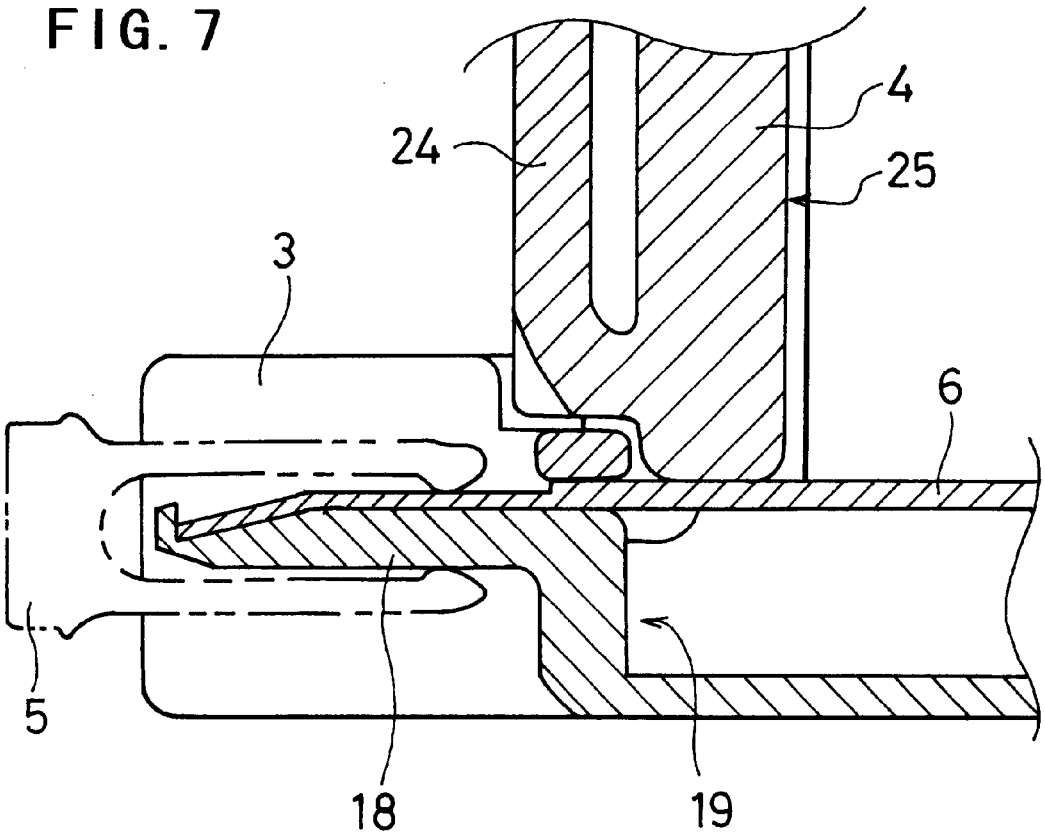
FIG. 7 is a sectional view showing the state in which the flexible flat cable is inserted in the male housing of the electrical connector assembly for flexible flat cable according to the present invention.

Shown in FIG. 7 is a sectional view of the part around the guide portion 18, illustrating the state in which the flexible flat cable 6 was inserted and guided into the guide portion 18. In this diagram, there is shown by a chain double-dashed line, for reference purpose, a positional relationship of the contact 5 to be connected to the relevant part when connected. As shown in FIG. 7, the flexible flat cable 6 is guided into the guide portion 18 so that the front end portion of the flexible flat cable 6 can slant partway along its length and is set in position by abutment with the guide portion 18 at the front end. This sectional view is taken along line extending in parallel with the slit 20.

Figure 8:
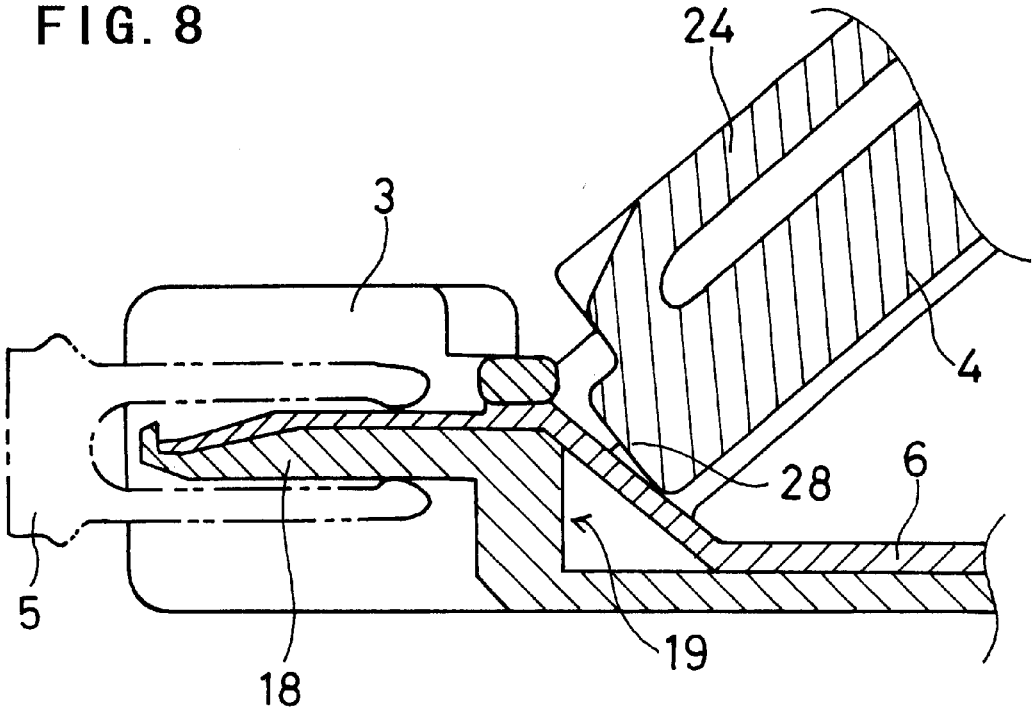
FIG. 8 is a sectional view showing the state in which a housing lock is turned from the position of FIG. 7 with respect to the male housing of the electrical connector assembly for flexible flat cable according to the present invention.

The housing lock 4 is turned from the position shown in FIG. 7. FIG. 8 shows in section the state in which the housing lock 4 is turned at an angle of about 45 degree. As shown in this diagram, along with the turning of the housing lock 4, the flexible flat cable 6 is gradually bent. At this time, a front end portion 28 of the housing lock 4 is turned so that it can push the flexible flat cable 6 in the insertion direction, so that even in the course of turning, the flexible flat cable 6 is held stationary with its front end kept in position.

Figure 9:
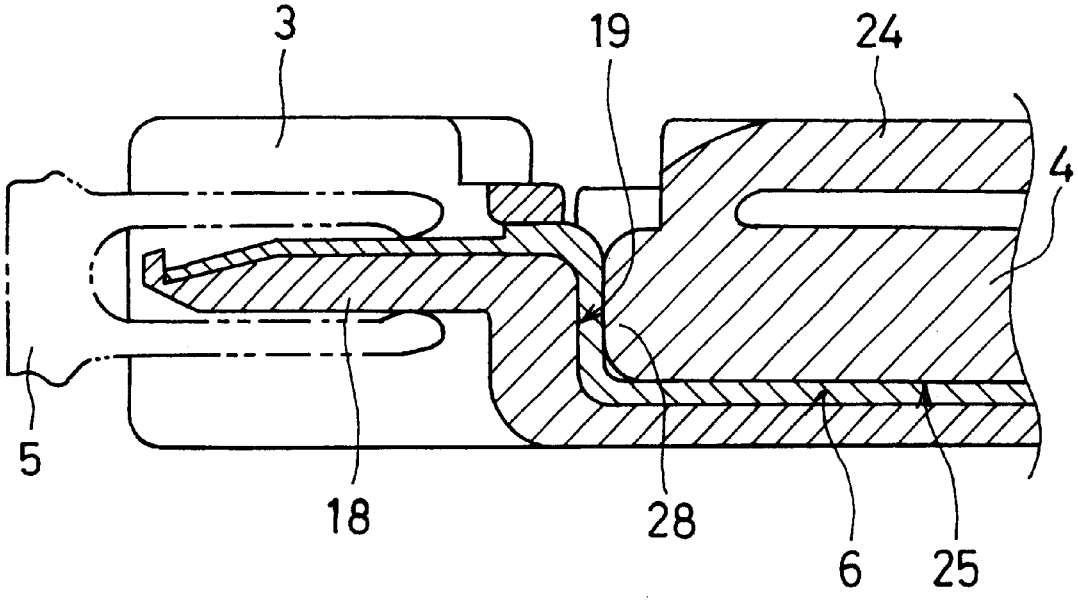
FIG. 9 is a sectional view showing the state in which the flexible flat cable is temporarily held in the electrical connector assembly for flexible flat cable according to the present invention.

FIG. 9 shows in section the state in which the turning of the housing lock 4 is completed. The housing lock 4 is turned at an angle of about 90 degree from the position of FIG. 7 until it is snugly accommodated in the male housing 3, thus bringing the turning of the housing lock 4 to a termination. In this process, the flexible flat cable 6 is pressed so that it can be bent twice in a sandwich relation between the concave portion 19 of the male housing 3 and the pressing portion 25 and front end portion 28 of the housing lock 4.

Since the flexible flat cable 6 is fixed with its bent twice at an angle of about 90 degree so as to prevent from slipping off in this manner, the flexible flat cable 6 can surely be kept in its connected and held state even when used in an environment subjected to vibration and external force.

At this time, the temporary holding slots 17 of the male housing 3 and the temporary holding lugs 27 of the housing lock 4 are engaged, and as such can allow the flexible flat cable 6 to be kept in its temporarily held state between the male housing 3 and the housing lock 4.

In the exploded perspective view of FIG. 1, the male housing 3 and the housing lock 4 which are in the state of temporarily holding the flexible flat cable 6 therebetween are shown at the right-hand side. From this position, the male housing 3 is inserted into the opening 7 of the female housing 2, in which the contacts 5 were fitted in their respective places and held in place, in the direction indicated by an arrow shown in FIG. 1. At this time, the insertion guide portions 14 are guided along the inner walls of the opening 7, and the cantilevered holding portion 24 and the lugs 16 are guided along the guide rims 10 and the guide slots 9, respectively. When the insertion of the male housing 3 is completed, the contacts 5 and the flexible flat cable 6 are connected with each other. FIG. 10 shows in section the state that the contacts 5 and the flexible flat cable 6 are in contact with each other. In this diagram, the female housing 2 is omitted, for easy understanding, as previously mentioned. In this state, the engaging lug 26 of the cantilevered holding portion 24 is fixedly held in the engaging groove 11 of the female housing 2 by the resilience of the cantilevered holding portion 24.

Since the housing lock 4 is inserted and fitted in the female housing 2 and also is fixedly held thereto in this manner, the flexible flat cable 6 can be further reliably prevented from slipping off from the connector and, therefore, the contacts 5 and the flexible flat cable 6 can surely be kept in their connected and held state.

As mentioned above, the combination of the male housing 3 and the housing lock 4 serves to hold the flexible flat cable 6 in place and further the insertion of the combined male housing 3 and housing lock 4 into the female housing 2 permits the flexible flat cable 6 to be prevented from slipping off and also permits the flexible flat cable 6 to be electrically connected with the contacts 5. Thus, the contacts 5 and the flexible flat cable 6 can reliably be kept in their connected and held state even when used in an environment subjected to vibration and external force.

When the connection between the contacts 5 and the flexible flat cable 6 is released, the cantilevered holding portion 24 of the housing lock 4 is pressed down at the free end side to be bent and thereby the engagement between the engaging lug 26 and the engaging groove 11 is released, first, and then the male housing 3 is drawn out from the female housing 2 with the engagement therebetween released.

The present invention should not be limited to the embodiment illustrated above and various changes and modifications may be made in the invention within the scope of the claims. To cite instances:

(1) While in the illustrated embodiment, there is illustrated the four point electrical connection between the contacts and the flexible flat cable, the present invention is not limited to the application to the four point electrical connection therebetween of the illustrated embodiment. The present invention can be applied to a three or less point electrical connection or a five or more point electrical connection.

(2) The structure for the flexible flat cable to be bent for the holding by the male housing and the housing lock is not limited to the structure of the illustrated embodiment wherein the flexible flat cable is bent along the stepped concave portion of an angle of generally 90 degree. Any form of the structure may be selected, as long as it can make the flexible flat cable bend for the holding. For instance, the concave portion may be presented in the form of a semicircular groove and also the pressing portion of the housing lock may be presented in the form of a corresponding semicircular lug to fit in such a semicircular groove.

(3) The housing lock need not necessarily be held in the male housing in such a manner as to freely turn with respect to it. For example, the housing lock may be so structured that it can bend and press the flexible flat cable by inserting the housing lock perpendicularly into the male housing and also can complete the connection and holding of the flexible flat cable by inserting the housing lock and male housing thus combined into the female housing.

(4) The housing need not necessarily comprise the male housing and the female housing which are separate from each other, as in the illustrated embodiment. It may alternatively comprise an integral-type housing. In this alternation, the contact holding portion, the guide portion for the flexible flat cable and the concave portion to fit to the housing lock are all integrally incorporated in the housing. Also, the housing lock and this housing are held by their respective engaging portions.

(5) The relation between the first engaging portion and the second engaging portion is not necessarily limited to that of the illustrated embodiment. The first engaging portion may be formed in a convex shape and the second engaging portion may be formed in a concave shape, and vice versa.

What is claimed is:

1. An electrical connector assembly for flexible flat cable used for electrically connecting a plurality of contacts and a flexible flat cable, the electrical connector assembly comprising (1) a housing including a contact holding portion in which the contacts are inserted and held; a guide portion in which the flexible flat cable is inserted and guided, to locate the flexible flat cable in the position in which the flexible flat cable is contactable with the contacts; and a concave portion formed to be recessed with respect to the guide portion, and (2) a housing lock to be freely rotatably engaged in the housing, the housing lock including a pressing portion to press the flexible flat cable for the holding in such a manner that the flexible flat cable as was inserted into the guide portion can be bent along the concave portion by a turning of the housing lock with respect to the housing, wherein the housing comprises a female housing having the contact holding portion at one end portion thereof and an opening at the other end portion and a male housing including the guide portion and the concave portion and adapted to be inserted in the opening to freely engage in the female housing; and wherein the housing lock is freely rotatably engaged in the male housing, and the housing lock is rotated after the flexible flat cable is inserted and guided into the guide portion, so that the housing lock is inserted in the female housing, together with the male housing, with the housing lock pressed to bend the flexible flat cable along the concave portion, whereby the contacts and the flexible flat cable are electrically connected and also the flexible flat cable is fixed in position, whereby the turning of the housing lock after the flexible flat cable is inserted and guided into the guide portion permits the contacts and the flexible flat cable to be electrically connected and also permits the flexible flat cable to be fixed in position.

2. The electrical connector assembly for flexible flat cable according to claim 1, wherein the concave portion is formed to be recessed stepwise with respect to the guide portion, and the flexible flat cable is bent twice or more at an angle of generally 90 degree between the concave portion and the pressing portion, so as to be held stationary.

3. An electrical connector assembly for flexible flat cable used for electrically connecting a plurality of contacts and a flexible flat cable, the electrical connector assembly comprising (1) a female housing having a contact holding portion in which contacts are inserted and held, and an opening formed at the other end and formed in a cylindrical shape, (2) a male housing to be inserted into the opening so as to freely engage in the female housing, the male housing having a guide portion in which the flexible flat cable is inserted and guided and a concave portion formed to be recessed with respect to the guide portion, and being abutted with the flexible flat cable at a front end portion thereof on the insertion side to locate the flexible flat cable in the position in which the flexible flat cable is contactable with the contacts; and (3) a housing lock to be freely rotatably engaged in the housing, the housing lock including a pressing portion to press the flexible flat cable for the temporal holding in such a manner that the flexible flat cable as was inserted into the guide portion can be bent along the concave portion by a turning of the housing lock with respect to the male housing and being inserted into the female housing, together with the male housing, with the flexible flat cable kept in its temporary holding state, wherein the insertion of the male housing, in which the flexible flat cable was temporarily held, into the female housing permits the contacts and the flexible flat cable to be electrically connected and also permits the flexible flat cable to be fixed in position.

4. A The electrical connector assembly for flexible flat cable according to claim 3, wherein the concave portion is formed to be recessed stepwise with respect to the guide portion, and the flexible flat cable is bent twice or more at an angle of generally 90 degree between the concave portion and the pressing portion, so as to be held stationary.

5. The electrical connector assembly for flexible flat cable according to claim 3, wherein the housing lock is supported at one end thereof on the non-pressing side in a cantilevered fashion and has a first engaging portion at a free end portion thereof, so that when the male housing and the female housing are fitted to each other, the first engaging portion is engaged with a second engaging portion formed in the female housing.

6. The electrical connector assembly for flexible flat cable according to claim 3, wherein the guide portion has, at a front end portion thereof on the insertion side, a tapered portion formed partway along its length to guide the flexible flat cable.

* * * * *